United States Patent [19]

De Cuir

[11] Patent Number: 4,865,125

[45] Date of Patent: Sep. 12, 1989

[54] HYDRAULIC JAR MECHANISM

[75] Inventor: Perry J. De Cuir, New Iberia, La.

[73] Assignee: Douglas W. Crawford, Lafayette, La.

[21] Appl. No.: 242,284

[22] Filed: Sep. 9, 1988

[51] Int. Cl.[4] ..... E21B 4/14

[52] U.S. Cl. ..... 166/178; 175/297; 175/299

[58] Field of Search ..... 166/178, 301; 175/297, 175/299, 135

[56] References Cited

U.S. PATENT DOCUMENTS

| | | | |
|---|---|---|---|
| 1,804,700 | 5/1931 | Maxwell | 175/297 |
| 2,222,646 | 11/1940 | Burns | 175/297 |
| 2,645,459 | 7/1953 | Sutliff | 175/297 |
| 2,989,132 | 6/1961 | Downen | 175/297 |
| 3,004,616 | 10/1961 | Nutter et al. | 175/297 |
| 3,005,505 | 10/1961 | Webb | 175/297 |
| 4,361,195 | 11/1982 | Evans | 175/299 X |
| 4,478,284 | 10/1984 | Tomm et al. | 175/299 X |
| 4,566,546 | 1/1986 | Evans | 175/297 |
| 4,658,917 | 4/1987 | Ring | 175/297 |

*Primary Examiner*—Stephen J. Novosad

[57] ABSTRACT

A hydraulic well jar mechanism capable of developing jarring force in an upwardly or downwardly direction or in both upward and downward directions for imparting jarring forces to stuck well pipe. Inner and outer tubular members cooperate to define an annulus therebetween, which annulus contains a volume of metering liquid such as oil. One or more metering valves are disposed within the annulus and establish metering of the metering liquid during a portion of the stroke of the well jar to thus retard movement thereof. After a certain metering movement has occurred, the operative metering valve will be clear of the metering surface and the jar mechanism will then have relatively free movement from the retarded position to the jarring position. Closing movement of the jar mechanism may be induced by a compression spring closure. The metering fluid within the annulus is balanced with well pressure while separated from well fluid by means of a floating piston disposed within the annulus and having sealed relation with both the inner and outer tubular members. The inner tubular member defines a central passage permitting insertion therethrough of well servicing tools, well fluid, etc.

22 Claims, 7 Drawing Sheets

FIG. 7A
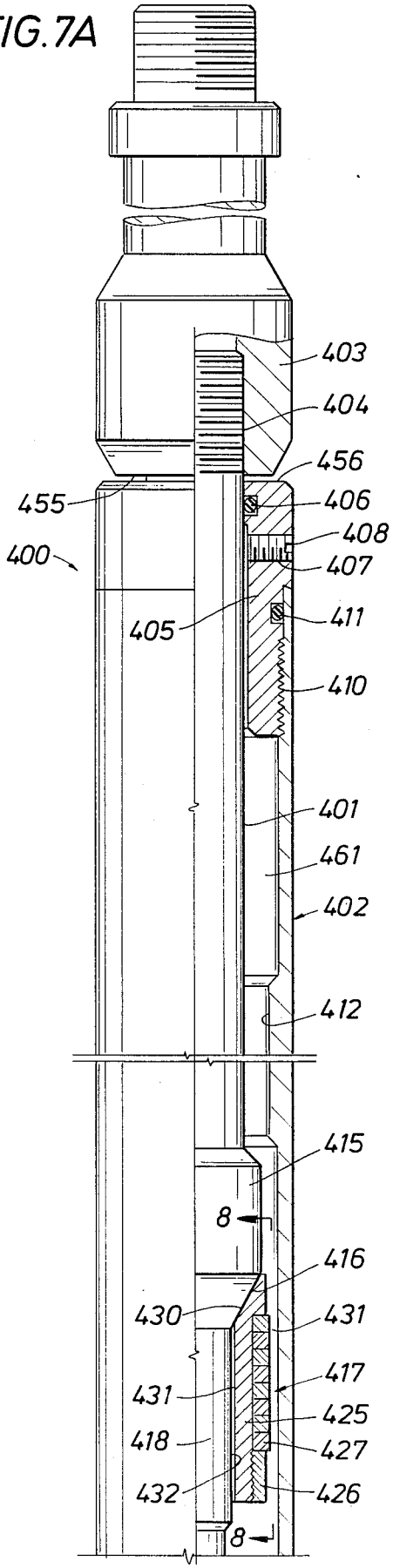
FIG. 7B
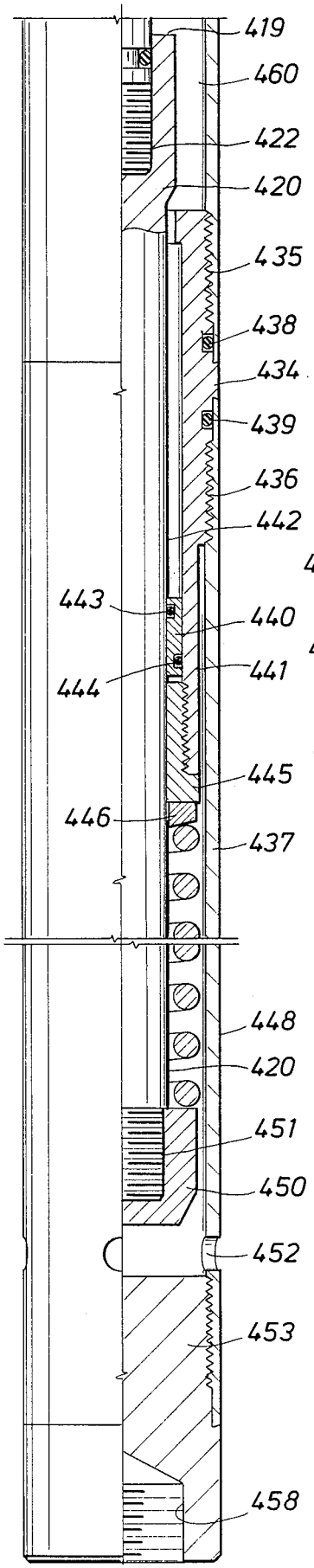
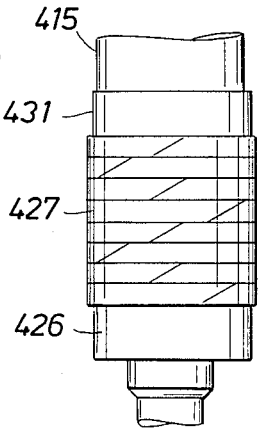
FIG. 8

HYDRAULIC JAR MECHANISM

FIELD OF THE INVENTION

This invention relates generally to well jars such as are typically employed for freeing stuck pipe within well bores. More specifically, this invention relates to a hydraulic well jar which incorporates a fluid metering system to establish a timing sequence to thereby achieve efficient jarring activity upon upward or both upward and downward movement of the jarring mechanism.

BACKGROUND OF THE INVENTION

When an oil well is drilled, the drill bit is positioned at the bottom of the drill string, and a set of heavy thick walled drill collars is located in the drill string immediately above the drill bit. The drill collars add stiffness to the drill string, control the weight on the drill bit, and thereby control lateral drift of the bit which thus controls the deviation of the hole being drilled. The number of drill collars in a drill string will vary depending upon the depth of the well, the particular formations encountered, etc.

During the drilling of an oil well which is typically considered deep well drilling, there is ample opportunity for the drill string to be seized at the drill collars. Typically, this will happen when a portion of the side wall of the well bore collapses and portions of the formation falls into the annulus between the pipe and the wall of the well bore, thereby causing seizing of the drill string at the drill collars. Even if the hole partially collapses well above the bottom of the hole, the formation material which falls into the annulus will accumulate just above the drill bit and thereby cause seizing of the drill string near the drill collars. Alternately, the presence of formation material between the drill pipe and the formation will cause the drill bit to be deflected somewhat and will thus cause the drill bit to drift from its intended course by virtue of the transverse force applied to it by the collapsed formation material. This places the drill string in a transverse bind so that it wears away the side of the well bore and forms a key seat where the drill collars are forced to the side of a part of the hole which was previously drilled. Such key seating forms narrow sections of the formation which are encountered as the collars are moved upwardly, thereby preventing extraction of the drill string from the well bore.

When, for any of the above mentioned reasons, or for other reasons not named, the drill string is seized, it is necessary to free it up. There are several ways of doing this. One way is to employ a well jar in the drill string for purposes of imparting a substantial impact to the drill string in the immediate vicinity of the place where it is stuck. Since sticking of the drill pipe typically occurs just above the drill bit at the drill collars, a jar mechanism in the drill string is quite advantageous.

Various pipe jarring devices have been provided heretofore which are particularly adapted to be utilized in drill strings and for otherwise releasing stuck well pipe. In most cases, well jars employ a pair of inner and outer telescoping members permitting relative movement of an upper section of pipe or a wire line tool, etc., relative to a stuck lower section of pipe. When the telescoping members are pulled to the full extent thereof, jarring occurs, which, after a time will loosen the well pipe and allow it to be removed from the well.

Jarring activity can occur on upward movement, downward movement or both.

Obviously, in the case of deep wells, it is difficult, if not impossible, to impart rapid jarring movement to stuck well pipe since the apparatus being moved within the well due to its significant weight is not capable of rapid movement by way of the surface equipment. In such case, it is desirable that the well jar have an inherent internal jarring activity by virtue of its construction. The present invention provides such an inherent jarring activity even during relatively slow upward or downward movement of the jar controlling system. It is believed, therefore, that the present invention provides a unique system for imparting efficient jarring activity to stuck well pipe and thus the invention constitutes a significant advance over prior well jar mechanisms.

A typical well jar employs a hydraulically operable detent to restrain upward movement of a mandrel within a housing while a strain is taken in the pipe string to stretch it and thereby store a large amount of potential energy. The detent meters slowly to a released position where the mandrel is allowed to move freely upward. Contraction of the pipe string accelerates the mandrel upward to bring a hammer surface thereon against an anvil surface on the housing in a violent manner. The jar is recocked by lowering the pipe string and mandrel to reengage the hydraulic detent, so that a series of jarring blows can be delivered to the stuck object. This type of well jar is shown and described, for example, in U.S. Pat. No. 2,645,459 issued July 14, 1953 to Wayne Sutliff. FIG. 5 of the patent suggests that the same concepts can be used in a wireline jar, with potential energy being stored by stretching the wireline 67.

The Sutliff-type jar is not designed to deliver a downward jarring blow. Even if the assembly were to be run upside down so that a downward blow is possible, only the weight of the pipe string is available to cause the hydraulic detent to meter to its released position and to bring the hammer against the anvil. If the well is deviated to any significant degree, the tubing will lay against the casing walls to produce frictional forces that reduce the weight available to operate the jar. This factor will extend the delay time for the hydraulic detent to meter free, and may prevent operation of the jar at all. Of course a wireline suspended jar would not work because there is no weight available to even operate the detent, or to cause an impact blow to be struck.

Thus the typical wireline jar has for many years taken the form of telescoping upper and lower links. The upper link can be raised quickly by the wireline to cause it to impact against the lower link and deliver an upward blow, or can be dropped against the lower link to deliver a downward blow. In well bores that are substantially vertical, the link-type wireline jar works well to shear pins and other devices as required. However, in deviated well bores, at least the upper link will tend to lay against the wall of the pipe, and here again frictional forces come into play that reduce operational efficiency, and may even prevent operation altogether.

SUMMARY OF THE INVENTION

An object of the present invention is to provide a new and improved well jar that will deliver an effective downward blow, even in highly deviated well bores.

Another object of the present invention is to provide a new and improved wireline jar that is cocked by tension in the wireline, and which delivers a downward jarring blow a predetermined time after tension in the wireline is relieved.

The present invention is defined by the provision of a pair of internal and external tubular members which are disposed in telescoping relation and are each provided with respective upper and lower connections for connection to jar inducing apparatus and for connection to stuck well pipe. The inner and outer tubular members define an elongated central bore or passage that permits the passage of well tools, well treating fluid and other servicing apparatus through the well jar mechanism to thus permit other well servicing operations while the well jarring mechanism is in place. The inner and outer tubular members also cooperate to define a metering annulus therebetween containing a volume of metering liquid such as a suitable oil. Intermediate the extremities of the metering annulus is provided a restriction forming a cylindrical metering surface. One or more metering valves are movably retained by one of the inner and outer tubular members and are capable of establishing a metering relationship with the cylindrical surface of the restriction. Upon relative telescoping movement of the inner and outer tubular members the liquid is metered between the metering valve and the cylindrical metering surface thereby providing a simultaneous timing function and movement retarding function. After sufficient telescoping movement has occurred, the metering valve will clear the cylindrical surface thereby permitting relatively unrestricted flow of liquid past the metering surface and thereby releasing the jarring mechanism for substantially free telescoping movement to its jarring position. The apparatus is adapted for both upward and downward jarring by means of a pair of spaced metering valves which are separated by means of a compression spring member. The metering valves are movable against the compression of the spring member responsive to the force developed thereagainst by the metering liquid as telescoping movement occurs. Upward jarring occurs as an internal thrust shoulder of the inner tubular member establishes jarring engagement with an internal thrust transmitting shoulder defined by the outer tubular member. In one form of the invention, a second metering restriction defines a portion of the annulus between the inner and outer tubular members, this restriction being located immediately adjacent an internal stop shoulder. As the inner and outer tubular members reach the maximum extended position thereof, another metering valve is moved into metering association with it. Upon reversal of jar movement, its metering activity with the second restriction retards closing telescoping movement and creates a jarring activity in the opposite direction.

Liquid contained within the metering annulus between the inner and outer tubular members is balanced with respect to well pressure by means of a floating piston movably disposed within the annulus and having sealing relation with both the inner and outer tubular members. Movement of the tubular members to the closed telescoping relation thereof may be enhanced by means of a compression spring located within a separate spring annulus defined between the inner and outer tubular members.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. *7a* and *7b* are sectional views illustrating upper and lower portions respectively of a well jar representing a modified embodiment of this invention.

FIG. 8 is a fragmentary transverse view of the detent mechanism taken along line 8—8 of FIG. *7a*.

DETAILED DESCRIPTION OF PREFERRED EMBODIMENT

Figure 1:
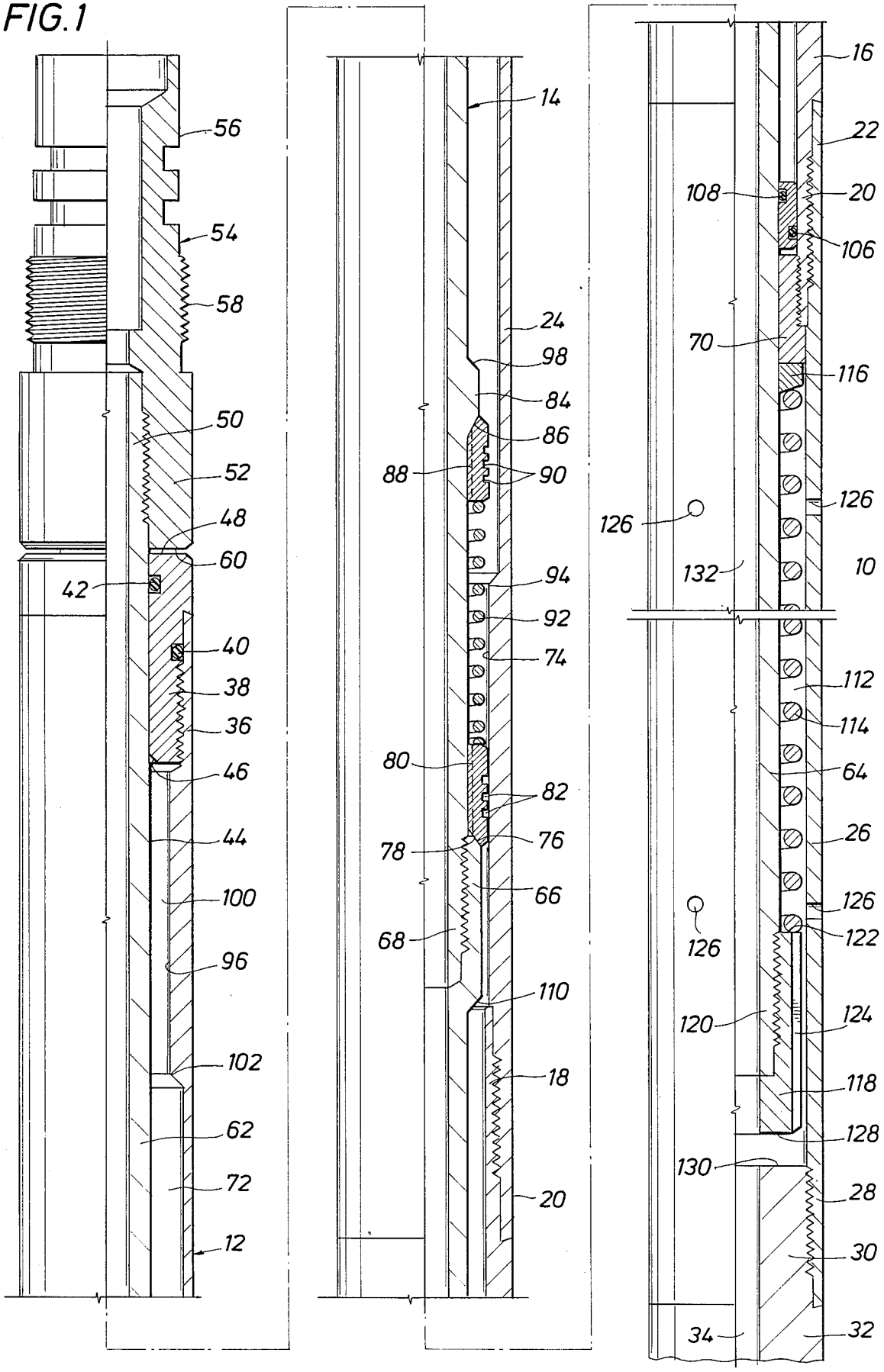
FIG. 1 is sectional view of a hydraulic well jar constructed in accordance with the present invention and being shown in the closed or collapsed telescoping position thereof.
Figure 2:
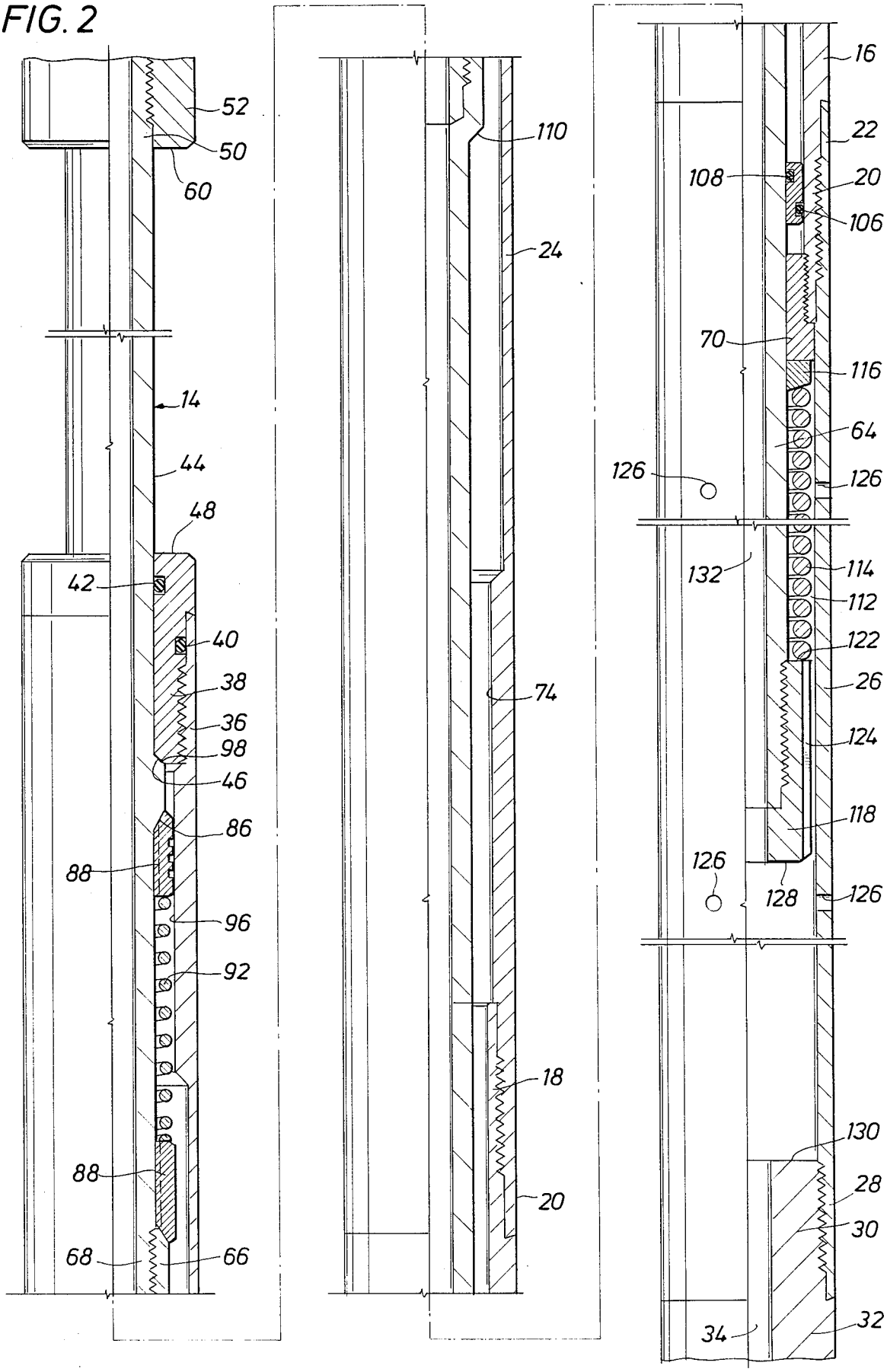
FIG. 2 is a sectional view of the hydraulic well jar mechanism of FIG. 1 being shown in the fully extended or open telescoping position thereof.

Referring now to the drawings and first to FIGS. 1 and 2, a hydraulic well jar mechanism constructed in accordance with the present invention is illustrated generally at 10 and includes an outer tubular member shown generally at 12 within which is telescopically received an inner tubular member illustrated generally at 14. The outer tubular member defines an intermediate body sub 16 having upper and lower externally threaded sections 18 and 20 which receive internally threaded sections 20 and 22 of upper and lower housing sections 24 and 26. The lower housing section 26 defines an internally threaded lower extremity 28 adapted to receive the externally threaded upper extremity 30 of a tool adapter sub 32. The adapter sub is provided with appropriate threads for connection to a pipe section or to a tool that makes connection with pipe that is stuck within the well bore. The adapter sub 32 is of tubular form defining an internal passage 34 through which well servicing tools, well treating fluid, etc., may pass to conduct servicing and treatment operations below the level of the well jar mechanism.

At its upper extremity, the upper housing section 24 is provided with an internally threaded section 36 receiving an externally threaded stop member 38. Stop member 38 is sealed with respect to the housing section 24 by means of an O-ring sealing element 40 and is provided with an internal seal 42 establishing sealed relation with the outer cylindrical surface 44 of the inner tubular member 14. The stop member 38 defines a tapered downwardly facing thrust surface 46 and an upwardly facing thrust surface 48.

At its upper end the inner tubular member 14 defines an externally threaded section 50 which is received within the internally threaded section 52 of a connector sub shown generally at 54. The connector sub 54 is provided with a typical fishing neck 56 and is also provided with an externally threaded portion 58 adapting it for connection to a pipe string or to a wire line tool as is desired suitable for the jarring operation. The connection sub 52 also defines a downwardly facing thrust shoulder 60 which is disposed for jarring engagement with thrust shoulder 48 as the jarring mechanism is collapsed or closed to its full telescoping extent.

The inner tubular member 14 defines an upper section 62 and a lower section 64 which are interconnected by internally and externally threaded sections 66 and 68. The upper stop member 38 and a lower stop nut 70 function as guide surfaces for the internal tubular member and maintain it in spaced, centralized relation with the outer tubular member 12 so as to define an elongated annulus 72 therebetween. Annulus 72 is more practically referred to as a metering annulus because a liquid material such as oil fills all or a substantial portion o±the annulus. The oil is metered in a controlled manner to resist opening or closing movement of the jar mechanism during a timing sequence after which the inner and outer tubular members are released for substantially free opening or closing jarring movement as the case may be.

Intermediate the extremities of the annulus 72, the upper section 24 of the outer housing 12 is formed to define an internal restriction in the form of an elongated cylindrical metering surface 74. The internally threaded enlargement 66 of the housing section 64 defines a tapered valve stop surface 76 which is normally engaged by a correspondingly tapered surface 78 of a metering valve 80. The metering valve is provided with a plurality of circular external grooves within which are received ring like seal members 82 which are similar to the piston rings of internal combustion engines. The metering valve with its seal rings establish relatively close fitting relationship within the internal cylindrical surface 74 such that a significant restriction is defined between the metering valve and surface 74 that a metering activity takes place during an initial segment of the opening movement of the jar mechanism.

Above the metering valve 80 the internal tubular member 14 defines a radially outwardly projecting shoulder 84 which defines a tapered stop shoulder 86 for a similar cylindrical metering valve 88. Metering valve 88 is provided with groove and seal rings 90 in the same manner as shown at 82. A compression spring 92 is interposed between the metering valves 80 and 88 and functions to ordinarily maintain them in seated engagement with the tapered stop surfaces 76 and 86. As the metering valves are subjected to the force of hydraulic fluid during metering activity, the metering valves will be forced away from their respective stop surfaces and will induce further compression to the spring member 92. This hydraulic activity will be encountered by the lower metering valve 80 as the hydraulic jar mechanism is nearing its fully closed condition. During movement of the hydraulic jar in the opening direction, the stop shoulder 76 will force the metering valve upwardly causing metering of fluid from the annulus area above the valve to the annulus area below the valve. This metering activity will continue until the metering valve 80 has moved sufficiently that its lower extremity clears the circular shoulder 94.

Metering activity in the opposite direction is also induced at the upper portion of the jar mechanism by virtue of another internal restriction defining an internal cylindrical surface 96. The annular enlargement 84 defines an upwardly facing tapered shoulder surface 98 which is enabled to move into the restricted annular area 100 defined between the inner cylindrical surface 96 and the outer surface 44 of the inner tubular member 14. When the shoulder 98 enters this annular restricted area, it moves in relatively unrestricted manner into stopping engagement with the internal stop shoulder 46. As the inner tubular member moves further upwardly the metering valve 88 enters the annular restricted area 100 and its sealing members 90 move into close fitting relation with the inner cylindrical surface 96. A hydraulic force is developed which unseats the metering valve 88 against its spring force thus permitting continuous upward movement of the inner tubular member until the tapered annular shoulder 98 moves into contact with the downwardly facing thrust shoulder 46 of the stop member 38. The metering valve may be internally fluted to permit it to move readily into the metering restriction.

With the inner tubular member extended to its fully open position and with the metering valve 88 moved upwardly to its maximum extent, sudden downward movement of the inner tubular member such as during closing will cause a reverse metering activity to take place between the metering valve 88 and the inner cylindrical sealing surface 96. This will induce a timing sequence resisting closing forces until such time as the metering valves clears the lower shoulder 102 of the upper restriction. After this has occurred, the inner tubular member will then be freed for rapid downward movement to the closed position shown in FIG. 1 whereupon the annular thrust shoulder 60 strikes the thrust shoulder 48 and imparts a severe jarring force to the outer tubular member and the stuck pipe to which it is connected.

It is desirable to compensate for slight volumetric changes within the fluid filled annulus chamber 72 and to compensate for leakage of hydraulic fluid. This is accomplished by providing a free piston within the annulus which is sealed with respect to the outer tubular member by a circular sealing element 106 and is sealed with respect to the inner tubular member by means of a circular seal member 108. The lower surface of the free piston will be in communication with well pressure and thus well pressure is transmitted through the free piston to the fluid in the annulus chamber, thus developing a pressure balanced condition with respect to well pressure. Also, in the event of loss of some or all of the metering fluid within the annulus chamber, the free piston will move upwardly under the influence of well pressure until it contacts the tapered shoulder surface 110.

Although spring induced movement of the inner and outer telescoping tubular members of the hydraulic jar is not a requirement, such is provided according to FIGS. 1 and 2. Below the guide and stop nut 70, the inner and outer tubular members define an elongated spring annulus 112 within which is disposed a coil spring member 114. The lower portion, 116 of the guide and stop member 70 defines a circular shoulder forming a seat for the upper extremity of the coil spring 114. A spring retainer member 118 is attached to a lower externally threaded extremity 120 of the lower section 64 of the internal tubular member 14. The spring retainer defines an annular shoulder 122 supporting the lower extremity of the coil spring. The coil spring is maintained under a certain degree of mechanical compression so that a closing force is always transmitted between the inner and outer tubular members. To prevent hydraulic locking of the spring annulus 112, t he retainer member 118 defines a plurality of external flutes 124 thus permitting relatively unrestricted passage of well fluid into and out of the annulus chamber. The outer tubular member is made perforate by a plurality of openings 126 which communicate the well fluid externally of the outer tubular member with the spring annulus 112. Thus, even during rapid movement of the inner tubular member within the outer tubular member, a condition of hydraulic locking or unusual hydraulic resisting force will not be developed.

In the fully closed position of the apparatus as shown in FIG. 1, a lower shoulder 128 of the spring retainer 118 will be disposed in spaced relation with an upwardly directed shoulder 130 of the tool adapter sub 32. This spaced relation permits sufficient space for a coiled electrical line in the event such is extended through the hydraulic jar mechanism, thereby permitting the degree of travel permitted for hydraulic jarring without inducing movement to the electrical line above and below the space between surfaces 128 and 130.

The various sections of the internal tubular member 14 cooperate to define a straight bore or passage 132 extending completely therethrough and permitting passage of well tools, well treating fluid, etc. for servicing operations down hole of the hydraulic jar apparatus.

Figure 3:
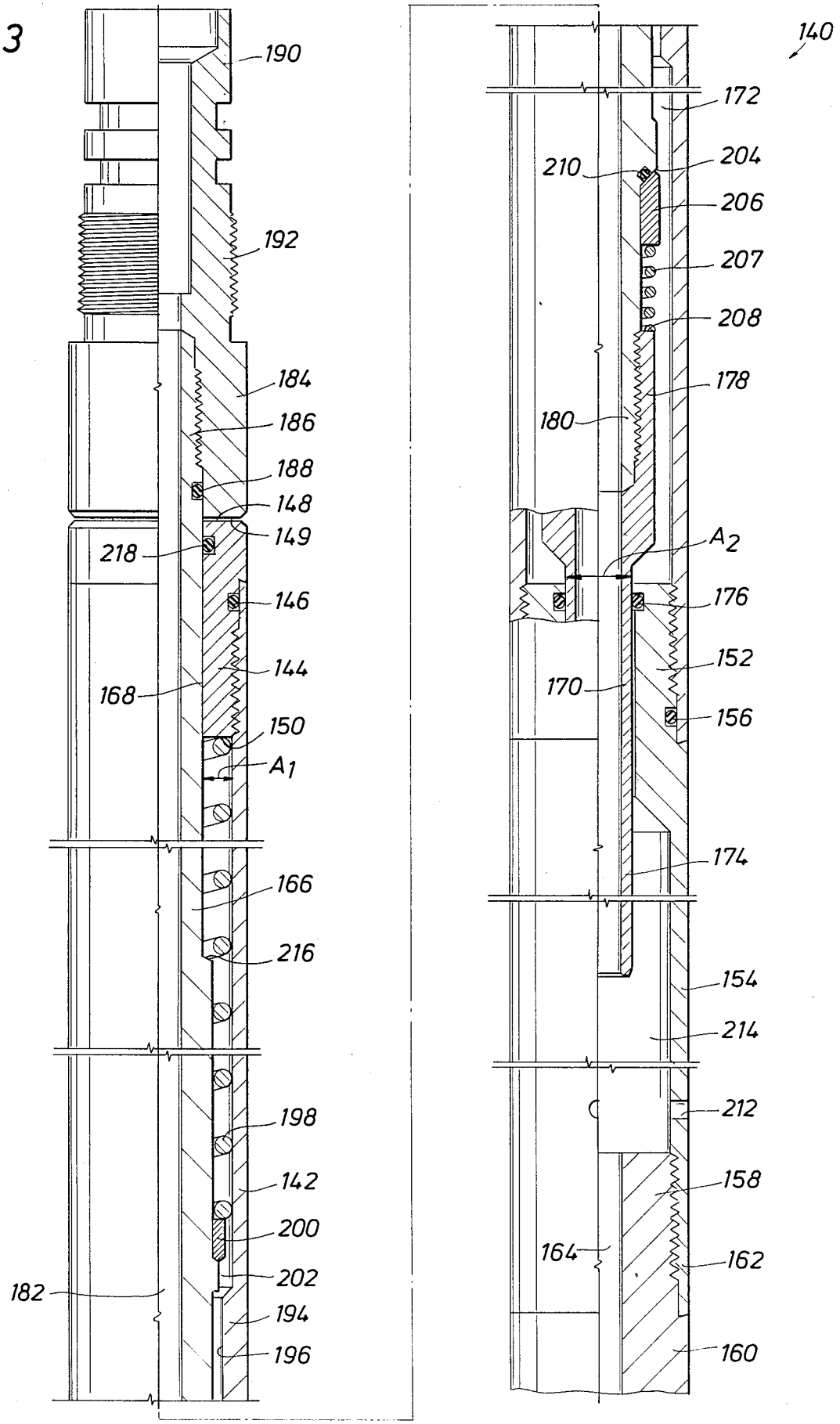
FIG. 3 is a sectional view of a hydraulic well jar mechanism representing an alternative embodiment of this invention and being shown in the closed or collapsed telescoping position thereof.
Figure 4:
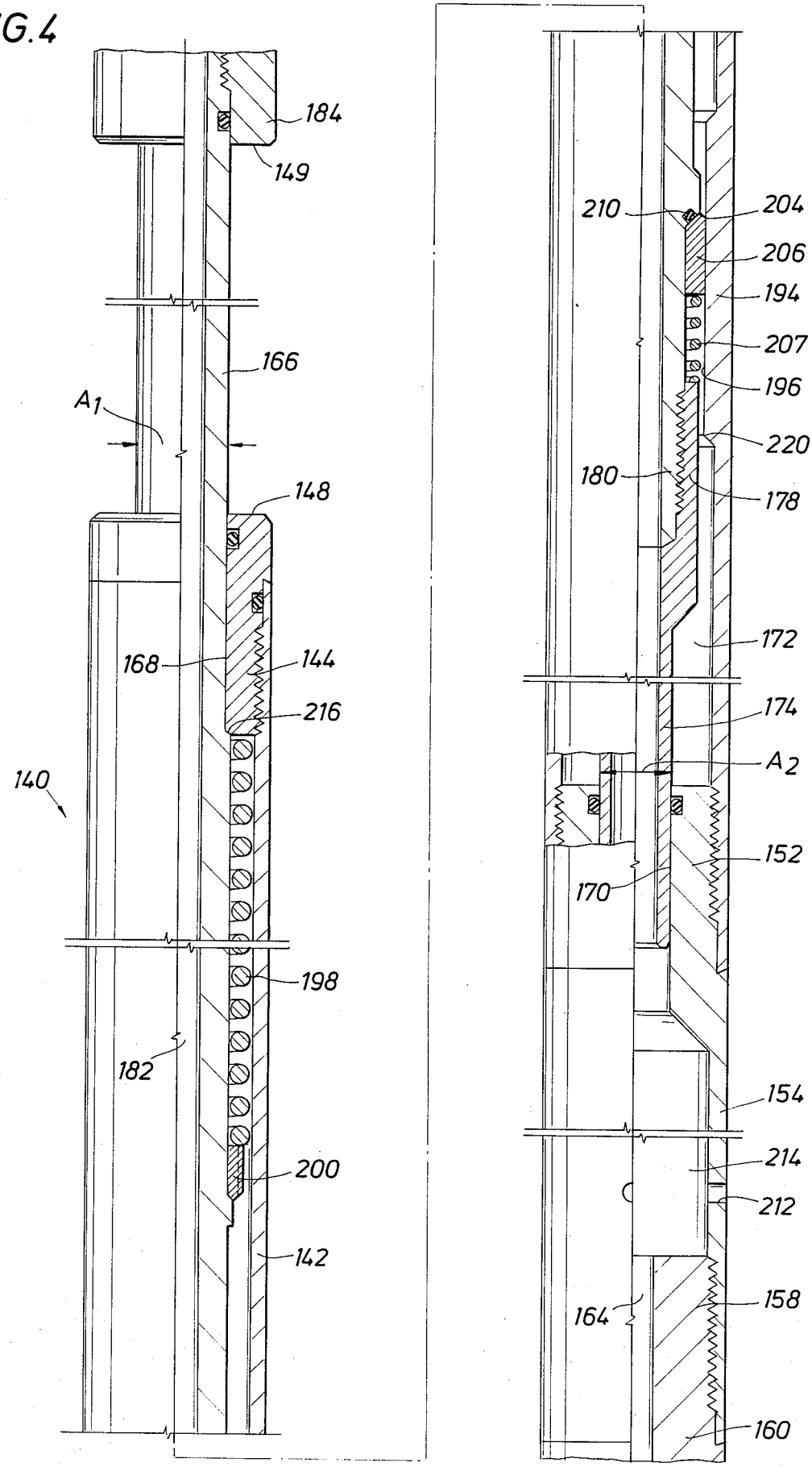
FIG. 4 is a sectional view of the hydraulic well jar apparatus of FIG. 3 shown in the fully opened telescoping position thereof.

Referring now to FIGS. 3 and 4 of the drawings, an alternative embodiment of the present invention is disclosed. FIG. 3 illustrates the alternative hydraulic well jar apparatus in its fully closed position while FIG. 4 illustrates the jar mechanism in its fully opened position. The hydraulic jar mechanism illustrated generally at 140 defines an outer tubular member 142 which is closed at its upper extremity by means of a stop member 144 having sealed relation maintained with the outer tubular member 142 by means of an annular sealing element 146. The stop member 144 defines an upwardly directed thrust surface 148 and a downwardly directed shoulder 150. The outer tubular member 142 is connected to an externally threaded section 152 of a lower housing member 154. A sealed relationship between housing member 154 and the outer tubular member 142 is maintained by means of a circular O-ring type sealing member 156. The internally threaded section 158 of a tool adapter sub 160 is secured to the lower internally threaded section 162 of the lower housing section 154. Sub 160 defines a central passage 164 permitting passage of well servicing tools and well treatment fluid therethrough. An inner tubular member is provided as shown at 166 which is maintained in spaced, concentric relation with the outer tubular member 142 by means of guide surfaces 168 and 170 defined respectively by the stop member 144 and the upper connection portion 152 of the outer housing section 154. By virtue of this spaced, concentric relation, the inner and outer housing cooperate to define a metering annulus 172 therebetween, the annulus being at least partially filled with a hydraulic fluid medium such as oil or any other suitable liquid. To the lower end of the inner tubular member 166 is connected a tubular guide extension contacting the guide surface 170 and being sealed with respect to the outer housing section 154 by means of an O-ring sealing element 176. The tubular guide extension 174 is provided with an upper internally threaded connector 178 receiving the externally threaded lower extremity 180 of the internal tubular member 166. The internal tubular member and the guide extension 174 cooperate to define a central passage 182 through which may be passed down hole servicing tools, well treating fluid, electrical cables, etc.

A connector element 184 is secured to the externally threaded upper extremity 186 of the inner tubular member and sealed with respect to the inner tubular member by means of a circular O-ring type sealing element 188. The connector element is provided with a conventional fishing neck 190 for connection to wire line tools. etc. and is also provided with an externally threaded section 192 providing for threaded connection thereof to well tubing or well pipe.

Intermediate the upper and lower extremities of the outer tubular member 142 is provided an elongated restriction 194 defining an internal cylindrical metering surface 196 in the annulus 172 above the restriction 194 is positioned an elongated coil spring 198 having its upper extremity in supported engagement with thrust surface 150 and its lower end in force transmitting engagement with a spring retainer ring 200 which is shown in stopping engagement with an annular enlargement 202 presenting a stop shoulder for engagement by the retainer ring. The compression spring 198 acting against thrust shoulder 150 and acting through the retainer ring 200 and enlargement 202, induces spring force to the inner tubular member 166 urging it downwardly toward the closed position shown in FIG. 3.

Downwardly of the restriction 194, the inner tubular member provides an enlargement 204 defining a tapered shoulder or seat receiving the upper tapered extremity of a generally cylindrical metering valve member 206. A coil spring 207 maintains the metering valve in its seated position and allows its movement responsive to the force of hydraulic fluid. The upper extremity of the connector 178 defines a stop shoulder 208 which serves to limit movement of the metering valve between the seat shoulder 204 and stop surface 208. The seat shoulder 204 may include a circular sealing element 210 against which the metering valve 206 establishes sealing engagement.

The lower housing section 154 is perforate as shown at 212, defining a plurality of vent openings establishing communication of the inner chamber 214 and the well environment externally of the outer housing. As the inner tubular member reciprocates within the outer housing during jarring activity, vent openings 212 will allow interchange of well fluid and will prevent the development of a condition of hydraulic locking within the chamber 214.

As shown in FIG. 4, the hydraulic jar mechanism is in its full open position with a stop shoulder 216 thereof disposed in engagement with the lower thrust transmitting surface 150 of the stop member 144. During such movement, the seal member 218 of the stop member maintains the sealed integrity of the oil containing annulus 172.

At the upper portion of the jarring tool, the annular area of the inner tubular member which is exposed to liquid pressure is defined as area A1 while at its lower portion a pressure responsive area A2 is defined. Area A2 is of slightly greater dimension as compared to area A1 and thus the jar mechanism is maintained closed by the resultant force developed by fluid pressure acting on the area differential of A1 and A2.

The jar mechanism depicted in FIGS. 3 and 4 is more aptly described as a downward jar. As the inner tubular member is moved upwardly to the position shown in FIG. 4, the spring member 198 is compressed as the stop or keeper 200 drives the upper end of the compression spring upwardly against the immovable thrust shoulder 150. As the stop shoulder 216 engages the thrust shoulder 150, the metering valve 206 will have been positioned within the cylindrical metering surface 196 of the restriction 194. Though the metering valve will yield downwardly against the compression of its spring 207 upon entering the metering restriction, the springs 207 will shortly thereafter move the metering valve to seated relationship against the seat surface 204. As movement of the jar is subsequently reversed and the inner tubular member is moved downwardly, fluid within the lower portion of the annulus chamber 172 will resist downward movement of the metering valve. During such downward movement, the hydraulic fluid within chamber 172 will be metered between the metering valve and the cylindrical surface 196. This will develop a timing sequence permitting mechanical loading of the jar mechanism prior to its release for jarring activity. Such preloading enhances the magnitude and efficiency of the jarring activity. Considerable force is applied to the inner tubular member to cause movement thereof in a downward direction during valve metering activity. As the metering valve 206 clears, the lower shoulder 220 of the cylindrical surface 196 substantially free downward movement of the inner tubular member will be permitted, such movement being aided by the compression of spring member 198. The metering activity represents a timing sequence allowing mechanical force build up to occur in the jar mechanism. As release occurs when the metering valve clears the shoulder 220, the inner tubular member will be released for rapid downward movement to the FIG. 3 position thereof. Downward jarring occurs as the downwardly facing thrust transmitting shoulder 149 of connector member 184 imparts jarring force to the upwardly directed thrust transmitting should 148 of stop member 144.

The jar mechanism disclosed in FIGS. 3 and 4 is not particularly intended as a drilling jar, but rather is a conventional jar that is run down-hole on a retrieval pipe string or a wire line tool to thus impart jarring force to stuck pipe. Conversion of the apparatus to a drilling jar may be readily accomplished simply by establishing a splined rotational driving connection between the inner and outer tubular members. It is intended therefore, that both drilling jars and vertical jarring devices be within the scope of the present invention.

Figure 5:
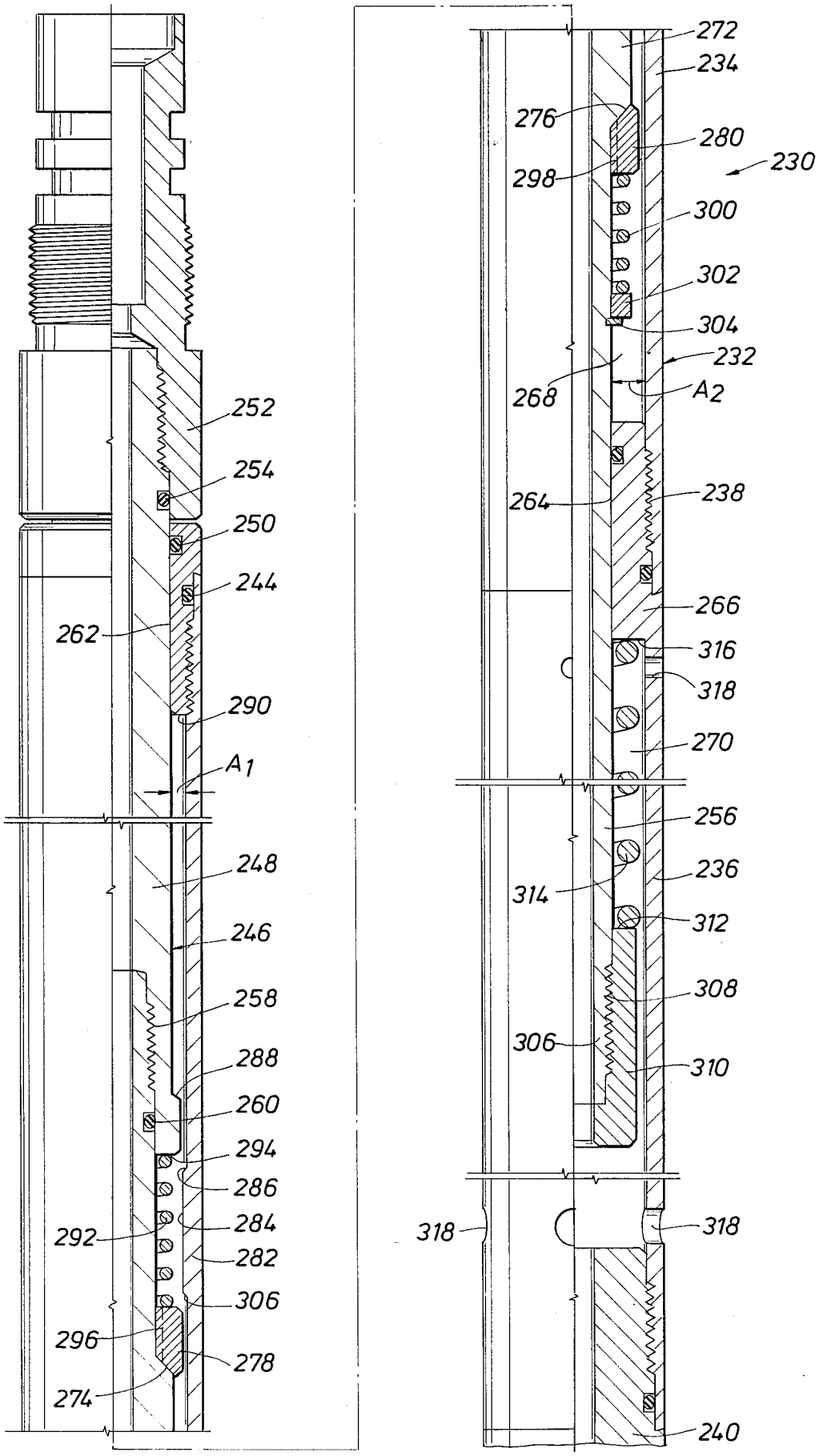
FIG. 5 is a sectional view of a further alternative embodiment of this invention, the well jar mechanism being shown in its telescopically closed position.
Figure 6:
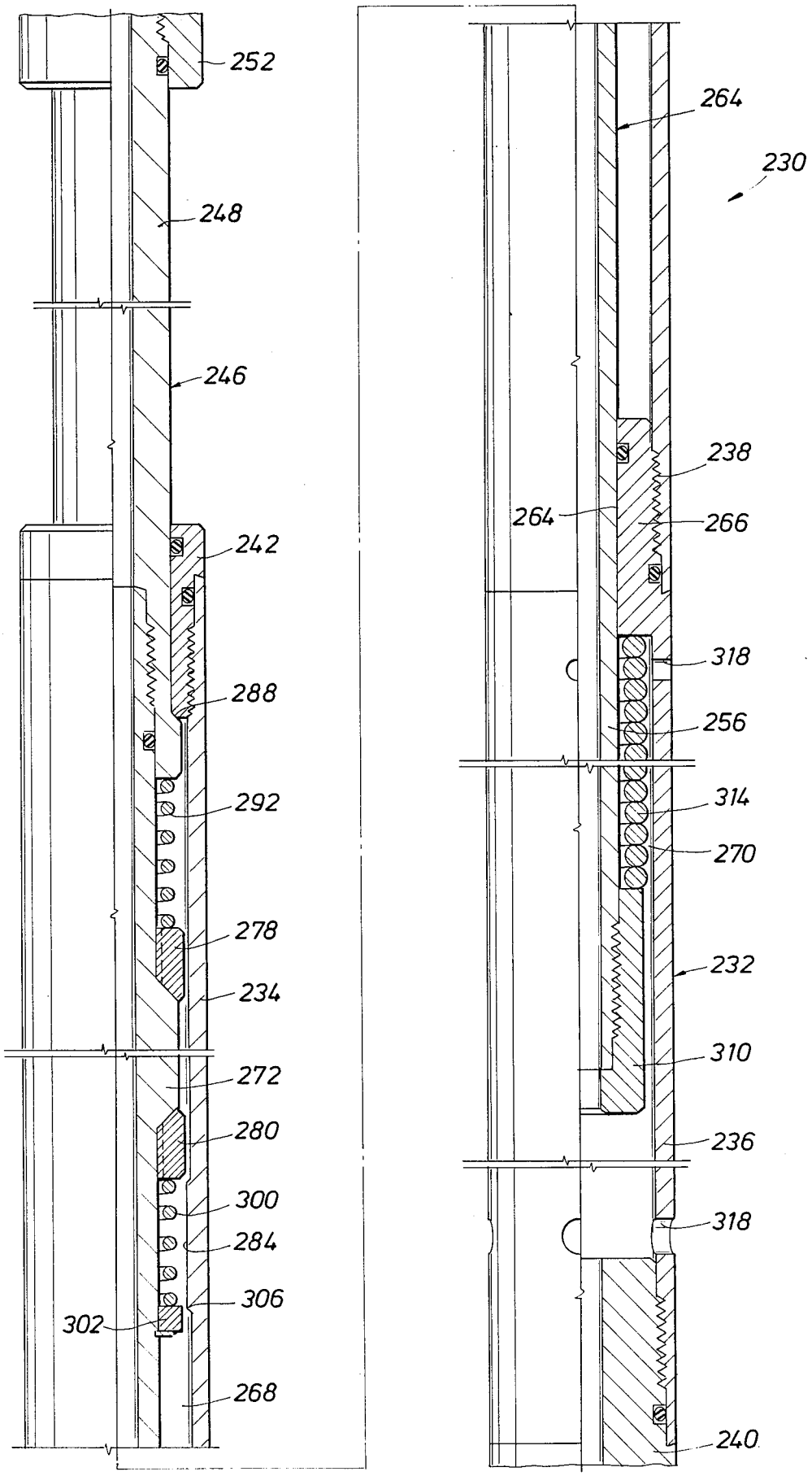
FIG. 6 is a sectional view of the well jar mechanism of FIG. 5 shown in the fully open telescoping position thereof.

Referring now to FIGS. 5 and 6, another alternative embodiment of the present invention is disclosed generally at 230 which includes an outer tubular member shown generally at 232 and being formed by upper and lower tubular sections 234 and 236 which are secured in assembly by means of a threaded connection 238. The lower tubular section 236 is threaded secured to a tool adapter sub 240 for attachment to stuck well pipe or an appropriate tool for retrieval. The upper end of the upper tubular section 234 is closed by means of a stop element 242 having sealed engagement therewith maintained by a circular sealing element 244.

Within the outer tubular member 232 is telescopically disposed an inner tubular member shown generally at 246 and being defined by an upper section 248 which is extended in guided relation through the stop member 242 and is sealed relative thereto by means of an annular sealing element 250. To the upper end of the tubular section 248 is secured a connector member 252 being sealed therewith by means of a circular O-ring seal 254. The connector 252 is of the same general nature as shown at 52 in FIGS. 1 and 2 and 184 in FIGS. 3 and 4. The upper tubular section 248 is secured to a lower tubular section 256 by means of a threaded connection 258. A sealed relationship is maintained between the upper and lower tubular sections by means of a circular O-ring seal 260. The inner cylindrical surface 262 of the stop member 242 and the inner cylindrical surface 264 of the upper connector section 266 of the lower tubular section cooperate to define cylindrical guide surfaces within which are received cylindrical surface portions of the upper and lower sections 248 and 256 of the inner tubular member. These guide surfaces maintain a concentric, spaced relation between the inner and outer tubular members to thus maintain them in spaced relation, defining an upper metering annulus 268 and a lower spring annulus 270 therebetween. Near the upper end portion of the lower tubular section and thus intermediate the length of the inner tubular member is located an annular external enlargement 272 forming tapered seat surfaces 274 and 276 at respective extremities thereof for seating engagement by metering valve elements 278 and 280, respectively. The outer tubular member defines an internal restriction 282 forming an inner cylindrical metering surface 284. During upward movement of the inner tubular member, as force is applied to the connector portion 252 thereof by appropriate surface controlled equipment. The upper metering valve 278, seated against support shoulder 274, is forced in close fitting relation through the restriction defined by the metering surface 284. In order for the inner tubular member to move upwardly, hydraulic fluid contained therein must be displaced into the annulus area below the metering valve 278. After the metering valve 278 has cleared the upper extremity 286 of the cylindrical surface 284 hydraulic fluid interchange will occur freely and thus free upward movement of the inner tubular member will be permitted. The metering activity develops a timing sequence enabling mechanical loading of the surface control jarring equipment. Upon completion of the timing sequence, the inner tubular member moves rapidly to its open position as shown in FIG. 6 whereupon thrust shoulder 288 establishes jarring engagement with a downwardly directed thrust shoulder 290 defined by the stop member 242.

It should be noted that the metering valve 278 is urged toward the shoulder 274 by means of a compression spring 292 having the upper end thereof engaging downwardly directed shoulder 294 of the upper section 248 of the inner tubular member. The compression spring 292 allows hydraulically induced movement of the annular metering valve away from its support shoulder and returns the metering valve to its seated position quite rapidly. It should also be borne in mind that the metering valve 278 may be internally fluted as shown in broken line at 296, allowing relatively free flow of hydraulic fluid past the inner circumference of the metering valve after it has been forced away from its seat by hydraulic activity.

Likewise, the lower metering valve 280 may be internally fluted as shown at 298 and is maintained against support shoulder 276 by means of a compression spring member 300. The lower end of the compression spring is supported by a circular spring retainer 302 which is secured in place by a snap ring 304 or other suitable stop member. During upward movement of the inner tubular member to the position shown in FIG. 6, the lower metering valve 280 will become hydraulically unseated and will not develop any significant metering activity as it passes through the cylindrical metering surface 284. Upon subsequent downward movement of the inner tubular member, the lower metering valve 280 will be forced through the metering restriction defined by surface 284 and will be maintained hydraulically seated against the support shoulder 276. The lower metering valve will thus develop a metering activity or timing sequence which induces mechanical loading of the jar mechanism permitting rapid jarring movement to occur after the lower metering valve has cleared the lower shoulder 306 of the metering restriction. Thus, jarring activity will occur upon both downward and upward movement of the inner tubular member and the jar mechanism may thus be referred to as a double acting jar.

At its lower end, the lower tubular section 256 of the inner tubular member defines an externally threaded section 306 which is received by the internal threads 308 of a retainer cap 310. The retainer cap defines a retainer shoulder 312 against which is seated the lower extremity of a compression spring 314 disposed within the spring annulus 270. The upper end of the compression spring engages a support shoulder 316. The compression spring member is compressed as the jar mechanism telescopes to its open position and assists in urging the inner tubular member towards its closed position. Fluid interchange between the environment externally of the jar mechanism and the spring annulus 270 is permitted by means of a plurality of vent ports 318 which are formed in the outer tubular member.

Like the other embodiments described in FIGS. 1–4 above, the jar mechanism of this invention is moved to its closed position as shown in FIG. 5 not only by the compression of spring member 314 but also by differential pressure which exists by virtue of differing areas exposed to well fluid. For example, area A2 is of greater dimension as compared with area A1 and thus fluid pressure acting upon these respective areas develops a resultant force urging the inner tubular member towards its closed position thereof.

Another embodiment of this invention is illustrated in FIGS. *7a* and *7b*. As shown in FIGS. *7a* and *7b*, the jar 400 includes a mandrel 401 that is telescopically received within a tubular housing indicated generally at 402. A connector sub 403 is threaded at 404 to the upper end of the mandrel 401, and is adapted to be secured to a wireline rope socket (not shown) by which the jar 400, and other tools suspended therebelow, can be lowered into the well bore. The housing 402 includes an upper sub 405 having a seal ring 406 that slidably engages the exterior surface of the mandrel 401, and an oil fill port 407 that normally is closed by a plug 408. The sub 405 is threaded to the upper end of an upper housing member 409, and fluid leakage past the thread 410 is prevented by a seal ring 411. The inner wall of the housing member 409 has a restricted bore 412 as shown in FIG. *7a*.

The mandrel 401 is provided with an enlargement 415 that defines a frusto-conical valve seat surface 416. A hydraulic detent mechanism, indicated generally at 417, is slidable relatively along the mandrel portion 418 between the enlargement 415 and an upwardly facing shoulder 419 provided by the upper end surface of a lower mandrel section 420 which is threaded at 422 to the upper section 421 of the mandrel. The detent mechanism 417 includes a sleeve 425 that carries a nut 426 and a stacked series of flow constrictor rings 427. As shown in FIG. 8, each of the rings 427 has a cut 428 through the wall thereof, with the cut being skewed with respect to the longitudinal axis of the ring. The rings 427 are assembled above the nut 426 with the cuts 428 circumferentially spaced with respect to one another so as to provide a tortuous leakage path. When the mandrel 401 is raised upward, the rings 427 fit snugly within the restricted bore 412 of the housing 402, and as the mandrel moves slightly downward, the valve surface 416 engages a companion inclined surface 430 on the upper end portion 431 of the sleeve 425 to provide a metal-to-metal seal. The inner surface 431 of the sleeve 425 has a larger diameter than the outer diameter of the adjacent wall surface 432 of the mandrel section 421. If desired, the upper surface 419 of the mandrel section 420 can be provided with notches, so that during upward movement of the mandrel 401 relative to the housing 402, hydraulic fluid can flow freely both internally and externally of the sleeve 425.

An adapter 434 is threaded at 435 to the upper housing section 409, and at 436 to a lower housing section 437. Seal rings 438, 439 prevent fluid leakage past these threads. An annular compensating piston 440 is mounted between the lower end portion 441 of the adapter 434 and the outer wall surface 442 of the mandrel section 420, and carries inner and outer seal rings 443, 444. A collar 445 that is threaded to the lower end of the end portion 441, together with a stop ring 446, provides a downwardly facing shoulder against which the upper end of a power spring 448 reacts. The lower end of the power spring 448 bears against an upwardly facing shoulder on a stop collar 450 that is threaded at 451 to the lower end of the mandrel section 420.

Several radial ports 452 communicate the interior of the housing 437 with the well annulus. A bottom sub 453, which is threaded to the lower end of the housing section 437, has an internal thread 454 for connecting the jar assembly to a kickover tool or the like therebelow. The outside diameter of the lower mandrel section 420 at the level of the compensating piston 440 is dimensioned to be slightly less than the outer diameter of the upper mandrel section 421 at the level of the seal ring 406. The lower surface 455 of the connector 403 provides a hammer surface that engages an anvil surface 456 on the upper end of the upper sub 405 when the mandrel 401 moves downward relative to the housing 402.

In operation, the jar 400, assembled as shown in the drawings, has the interior spaces thereof between the upper sub 405 and the compensating piston 440 filled with a suitable hydraulic oil via the fill port 407. The power spring 448 tends to maintain the mandrel 401 and the housing 402 in the telescoped or retracted relative position. The lower sub 453 is connected to a kickover tool or other wireline device, and the connector sub 403 as attached to a wireline by which the assembly is lowered into the production pipe of a well. When it is desired to strike a downward blow to shear a pin or the like, a strain is taken in the wireline at the surface. The housing 402 being held stationary, such strain causes the mandrel 401 to move upward, compressing the power spring 448 and causing the hydraulic detent mechanism 417 to move into the restricted bore 412 of the housing section 409. The sleeve 425 and the constrictor rings 427 are easily moved into the bore 417 because the sleeve will move down against the shoulder 419 where ample bypass flow area is provided between the surfaces 431 and 432. As strain in the wireline is relieved, the power spring 448 will force the mandrel 401 downward to cause the valve surface 416 to engage the valve surface 430 on the sleeve 425, after which further downward movement of the mandrel is restrained by the hydraulic detent 417. The detent mechanism 417 meters slowly downward through the restricted bore 412 under the force supplied by the power spring 448, as hydraulic fluid flows from the internal space 460 below the detent to the internal space 461 thereabove via the tortuous flow path provided by the skewed cuts in the constrictor rings 427 and the clearances between the rings.

When the uppermost constrictor ring 427 clears the lower end of the restricted bore 412, the power spring 448 accelerates the mandrel 401 downward relative to the housing 402, which brings the hammer surface 455 down against the anvil surface 456 with sudden impact. The jarring blow is transmitted by the housing 402 to the tools connected therebelow, and functions to shear a pin or other frangible element by which the kickover tool is secured to a flow control device. The compensating piston 440 equalizes the pressure of the oil in the chamber 460 with well pressure as the jar is being lowered to operating depth, and can move down against the collar 445 in response to a greater pressure in the chamber space 460 than in the well annulus. If one jarring blow is not sufficient, repeated blows can be struck by repeatedly taking and releasing a strain in the wireline.

In view of the foregoing, it is seen that the present invention disclosed in each of the embodiments is a hydraulic metering well jar mechanism developing a timing sequence that inherently enhances jarring activity whether jarring is upwardly, downwardly, or both upwardly and downwardly. The apparatus is urged to its closed position by pressure differential existing by virtue of differing pressure responsive areas. Therefore, the jar mechanism cannot open inadvertently responsive to well pressure conditions. The internal hydraulic fluid system thereof is pressure balanced with respect to external fluid pressure. The apparatus may serve in the form of a drilling jar or in the form of a more conventional apparatus developing jarring activating upon simple upward or downward movement. It is therefore apparent that the present invention is one well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

What is claimed is:

1. A hydraulic well jar mechanism adapted for connection to a pipe string or a wire line tool and adapted for single or double acting jarring of stuck pipe in a well bore, said well jar mechanism comprising:

(a) an elongated inner tubular member forming a connector at the upper end thereof and forming a tool passage for passage of well service tools and fluid therethrough;

(b) an elongated outer tubular member forming a connector at the lower end thereof and receiving a major portion of said elongated inner tubular member in movable telescoping relation therein, said outer tubular member also permitting passage of well tools and fluid therethrough, said inner and outer tubular members cooperating to define a closed, variable volume, liquid containing annulus therebetween;

(c) means defining a restriction intermediate the extremities of said liquid containing annulus;

(d) metering valve means being located in said liquid containing annulus and establishing liquid metering relation with said restriction responsive to telescoping movement of said inner and outer tubular members, said metering valve means having relatively movable relation with said restriction and, upon cleaning said restriction, permitting immediate transition to substantially unrestricted flow of liquid past said restriction and thus a jarring transition from retarded to substantially free telescoping movement of said inner and outer elongated tubular members;

(e) said elongated inner and outer tubular members cooperate to define a spring chamber annulus therebetween; and (f) an elongated coil spring member within said spring chamber annulus to impart closing force between said elongated inner and outer tubular members for inducing collapsing telescoping movement thereof.

2. The apparatus of claim 1, wherein:

(a) said restriction defines a cylindrical surface; and (b) said metering valve means establishes slight fluid metering clearance with said cylindrical surface.

3. The apparatus of claim 2, wherein:

said metering valve is of generally cylindrical form and is disposed in surrounding relation with said elongated inner tubular member.

4. The apparatus of claim 3, wherein:

(a) said metering valve defines external sealed groove means; and (b) seal ring means are disposed within said seal groove means and establish metering relation with said cylindrical surface.

5. The apparatus of claim 1, wherein:

(a) said restriction defines a cylindrical metering surface; and (b) said metering valve means comprises a pair of generally cylindrical valve elements disposed in encircling relation with said elongated inner tubular member; and (c) spring means urging said metering valves away from one another.

6. The apparatus of claim 5, wherein:

said elongated inner tubular member defines spaced valve stops, said spring means urging said spaced-valve elements into engagement with said valve stops, said metering valve means being movable away from said valve stops responsive to liquid induced force during relative telescoping movement of said elongated inner and outer tubular members.

7. The apparatus of claim 1, wherein:

said inner and outer tubular members define opposing thrust shoulders which are disposed in thrust transmitting engagement at the fully collapsed positions of said elongated inner and outer tubular members, thus, providing for downward jarring activity.

8. The apparatus of claim 7, wherein:

(a) said elongated outer tubular member defines an internal thrust transmitting shoulder; and (b) said elongated inner tubular member defines an external thrust transmitting shoulder, upon full telescoping extension of said elongated inner and outer tubular members, said external thrust transmitting shoulder of said elongated inner tubular member engages said internal thrust transmitting shoulder of said elongated outer tubular member thereby transmitting jarring force from said elongated inner tubular member to said elongated outer tubular member.

9. The apparatus of claim 1, including:

means within said well jar mechanism communicating well pressure to said closed, variable volume liquid containing annulus and establishing a pressure balanced relationship therebetween.

10. The apparatus of claim 9, wherein:

said pressure communicating means comprises a cylindrical floating piston disposed within said closed variable volume liquid containing annulus and establishing sealed relationship with both said elongated inner and outer tubular members 11. The apparatus of claim 11, wherein:

said outer tubular member is sufficiently perforate to permit substantially free well fluid interchange within said spring containing annulus during relative telescoping movement of said elongated inner and outer tubular members.

12. The apparatus of claim 1, wherein:

(a) an externally fluted stop member is provided at the lower extremity of said elongated inner tubular member and forms a spring stop shoulder;

(b) means within said well jar mechanism defines a spring stop shoulder at the upper extremity of said spring containing annulus, said elongated coil spring member has respective extremities thereof in force transmitting engagement with said stop shoulders, thus imparting spring closing force urging said elongated inner tubular member toward the collapsed position thereof.

13. A hydraulic well jar mechanism adapted for connection to a pipe string or a wire line tool and adapted for single or double acting jarring of stuck pipe in a well bore, said well jar mechanism comprising:

(a) an elongated inner tubular member having a connector at the upper end thereof for connection to said pipe string or said wireline tool and forming a straight internal bore defining a passage for well service tools, fluid, and other well servicing apparatus, said connector including a downwardly facing thrust shoulder;

(b) an elongated outer tubular member forming a connector at the lower end thereof for connection to well pipe and receiving a major portion of said elongated inner tubular member in movable telescoping relation therein, said elongated inner and outer tubular members cooperating to define a closed, variable volume liquid containing annulus therebetween;

(c) said elongated outer tubular member including an internal restriction intermediate the length of said closed, variable, volume liquid containing annulus, said restriction forming a cylindrical internal surface;

(d) external valve stop surface means supported by said elongated inner tubular member;

(e) metering valve means cooperative with said elongated inner tubular member and adapted for close fitting movable relation with said internal cylindrical surface when located therein causing controlled metering of liquid between said metering valve and said internal cylindrical surface upon initial opening telescoping movement of said elongated inner tubular member relative to said elongated outer tubular member, following movement of said metering valve means clear of said internal cylindrical surface, said liquid metering immediately ceasing and said elongated inner tubular member thereafter having substantially free telescoping movement to its jarring position with said elongated outer tubular member;

(f) said elongated inner and outer tubular members forming a spring annulus therebetween;

(g) spring shoulder means is defined by each of said elongated inner and outer tubular members, said spring shoulder means defining respective upper and lower ends of said spring annulus; and (h) elongated coil spring disposed within said spring annulus and having opposite end thereof in thrust transmitting engagement with said spring shoulder means, said coil spring imparting closing telescoping force to said elongated inner tubular member.

14. The apparatus of claim 13, wherein:

(a) said valve stop means is in the form of a pair of spaced valve stop surfaces defined by said elongated inner tubular member; and (b) said metering valve means being a pair of generally cylindrical metering valves surrounding said elongated inner tubular member, one of said valves forming a metering function during upward movement of said elongated inner tubular member and the other of said metering valves having liquid metering relation with said inner cylindrical surface during downward telescoping movement of said elongated inner tubular member.

15. The apparatus as recited in claim 13, wherein:

a floating piston is movably positioned within said closed variable volume liquid containing annulus and is disposed in sealed relation with both said elongated inner and outer tubular members, said floating piston permitting transmission of well pressure to said closed variable volume liquid containing annulus while maintaining separation of well fluid from fluid within said closed variable volume liquid containing annulus.

16. The apparatus of claim 13, wherein:

said elongated outer tubular member is perforate in the region of said spring annulus, thereby permitting substantially free interchange of well fluid to and from said spring annulus upon opening or closing telescoping movement of said elongated inner and outer tubular members and thereby insuring against a condition of hydraulic locking.

17. A well jar comprising:

(a) an inner member telescopically disposed within an outer member for movement from an extended to a contracted relative position, said members having hammer and anvil surfaces adapted to be engaged in said contracted position to deliver a jarring blow, one of said members being adapted to be connected to a wireline by which said jar is suspended in a well bore;

(b) compressible means operable upon movement of said members to said extended position for biasing said members toward said contracted position; and (c) hydraulic detent means operable in said extended position for momentarily delaying movement of said members to said contracted position, release of said detent means enabling said compressible means to quickly move said members to said contracted position and thereby bring said hammer surface into engagement with said anvil surface to create said jarring blow.

18. The jar of claim 17 wherein said compressible means is a coil spring that reacts between said inner member and said outer member.

19. The jar of claim 17 wherein said hydraulic detent means includes a sleeve structure on said inner member arranged to be moved into a restricted bore on said outer member, and coengageable check valve means on said sleeve structure and said inner member that is opened in response to extension of said members and closed in response to contraction thereof.

20. The jar of claim 19 wherein said sleeve structure includes a sleeve member and a series of flow constricting rings mounted on said sleeve member, said rings providing a tortuous flow path for the leakage of fluid from one side of said sleeve structure to the other when said sleeve structure is positioned in said restricted bore.

21. The jar of claim 20 wherein each of said rings has a cut through a section thereof, said rings being arranged on said sleeve member such that said cuts are misaligned.

22. The jar of claim 21 wherein said cut in each of said rings is skewed with respect to the longitudinal axis of said sleeve member.

* * * * *